US011719265B2

(12) United States Patent
Johnson et al.

(10) Patent No.: US 11,719,265 B2
(45) Date of Patent: Aug. 8, 2023

(54) COOLER BYPASS VALVE ASSEMBLY FOR HYDRAULIC SYSTEM RETURN CIRCUIT

(71) Applicant: Caterpillar Inc., Peoria, IL (US)

(72) Inventors: Gustaf Andrew Johnson, Morton, IL (US); Pengfei Ma, Naperville, IL (US); Jordan Garrity, West Lafayette, IN (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 17/320,480

(22) Filed: May 14, 2021

(65) Prior Publication Data

US 2022/0364581 A1 Nov. 17, 2022

(51) Int. Cl.
*F15B 21/0423* (2019.01)
*E02F 9/22* (2006.01)

(52) U.S. Cl.
CPC ..... *F15B 21/0423* (2019.01); *E02F 9/226* (2013.01); *E02F 9/2267* (2013.01)

(58) Field of Classification Search
CPC ..... F15B 21/0423; F15B 2211/62; F15B 2211/611; F15B 13/023; F15B 13/024; E02F 9/226
See application file for complete search history.

(56) References Cited

U.S. PATENT DOCUMENTS 3,401,605 A * 9/1968 Born ..... G05D 23/1333 60/329
3,913,831 A 10/1975 Talak
5,666,807 A * 9/1997 Bianchetta ..... F15B 21/0427 60/329
6,672,056 B2 * 1/2004 Roth ..... B66F 9/22 60/456

(Continued)

FOREIGN PATENT DOCUMENTS

CN 104790446 A * 7/2015
DE 102012112932 A1 * 6/2014 ..... B66F 9/22

(Continued)

OTHER PUBLICATIONS

Machine translation of DE 102012112932 A1 to Schwab. (Year: 2022).*

(Continued)

*Primary Examiner* — Thomas E Lazo

(57) ABSTRACT

A work machine includes a frame, a traction system supporting the frame, an implement system supported by the frame, and a hydraulic system. The hydraulic system includes a hydraulic oil tank, a control circuit, an oil cooler, and a cooler bypass valve assembly. The cooler bypass valve assembly is connected to the control circuit by a control circuit return line, and includes an unloading valve configured to allow hydraulic oil to flow from the control circuit return line to the hydraulic oil tank if a pressure of hydraulic oil in the control circuit return line exceeds a first threshold, (Continued)

a backpressure valve configured to allow hydraulic oil to flow from the return line to the oil cooler through an oil cooler inlet line if a pressure of hydraulic in the oil control circuit return line exceeds a second threshold, and an orifice configured to limit the flow of hydraulic oil through the backpressure valve.

17 Claims, 6 Drawing Sheets

(56) References Cited

U.S. PATENT DOCUMENTS

| | | | | |
|---|---|---|---|---|
| 6,845,614 | B2 * | 1/2005 | Stahlman | F04B 53/08 137/884 |
| 6,935,569 | B2 * | 8/2005 | Brown | F16H 57/0413 236/93 R |
| 8,042,333 | B2 * | 10/2011 | Friesen | F15B 21/0423 60/484 |
| 9,098,095 | B2 * | 8/2015 | Strzelczyk | G05D 23/1333 |
| 10,260,824 | B2 | 4/2019 | Brinkley et al. | |
| 10,648,489 | B2 | 5/2020 | Fukuda et al. | |
| 10,746,200 | B1 * | 8/2020 | Adeeb | F15B 13/06 |
| 2011/0061744 | A1 | 3/2011 | Zillig | |
| 2014/0193230 | A1 * | 7/2014 | McWethy | E02F 3/435 414/815 |

FOREIGN PATENT DOCUMENTS

| | | | | |
|---|---|---|---|---|
| DE | 102012112932 | A1 | | 6/2014 |
| EP | 3800096 | B1 | | 5/2022 |
| JP | 09014215 | A | * | 1/1997 |
| JP | 2014062371 | A | | 4/2014 |

OTHER PUBLICATIONS

Written Opinion and International Search Report for Int'l. Patent Appln. No PCT/US2022/028032, dated Jul. 15, 2022 (11 pgs).

* cited by examiner

COOLER BYPASS VALVE ASSEMBLY FOR HYDRAULIC SYSTEM RETURN CIRCUIT

TECHNICAL FIELD

The present disclosure relates generally to valve assemblies, and more specifically to valve assemblies for hydraulic oil circuits.

BACKGROUND

Many work machines, such as hydraulic mining shovels, bulldozers, backhoes, front loaders, or excavators, utilize an implement system to manipulate materials such as dirt, gravel, ore, stone, concrete, and the like. The implements may be provided in various forms and could include shovels, buckets, hydraulic hammers, fork lifts, blades, augers, movers, grapples, rippers, saws, and other similar tools. Such work machines are used in numerous industries, including, but not limited to, earth moving, construction, agriculture, and mining.

The implement system on these machines typically incorporates multiple arm segments capable of maneuvering the implement to perform its function. The movements of the arm segments and the implement are commonly driven by a hydraulic system. These hydraulic systems typically include a tank of hydraulic oil feeding a hydraulic pump. The pump sends hydraulic oil to hydraulic cylinders and other actuators through pressurized lines. From the cylinders, the oil moves into a return circuit. In the return circuit, a portion of the oil returns directly to the hydraulic oil tank while some oil is diverted to an oil cooler.

This division of the flow requires a combination of valves to control the flow and pressure of the oil. In some cases, the pressure in the lines before or after the valves may exceed operating limits, resulting in burst hoses and other damage.

Some systems address this problem by including a valve switching control system. For example, as described in U.S. Pat. No. 10,260,824 to Brinkley et al. The Brinkley patent teaches cooler bypass valve assembly which is adjustable between a first position and a second position. However, the valve arrangement of Brinkley requires complex controlling and non-standard parts. Therefore, there remains a need for a simpler cooler bypass valve assembly capable of maintaining the required pressure and flow rate.

SUMMARY OF THE DISCLOSURE

According to one aspect of the present disclosure, a work machine is disclosed. The work machine includes a frame, a traction system supporting the frame, an implement system supported by the frame, and a hydraulic system. The hydraulic system includes a hydraulic oil tank, a control circuit, an oil cooler, and an cooler bypass valve assembly. The cooler bypass valve assembly is fluidly connected to the control circuit by a control circuit return line, and includes an unloading valve configured to allow hydraulic oil to flow from the control circuit return line to the hydraulic oil tank if a pressure of hydraulic oil in the control circuit return line exceeds a first threshold, a backpressure valve configured to allow hydraulic oil to flow from the return line to the oil cooler through an oil cooler inlet line if a pressure of hydraulic oil in the control circuit return line exceeds a second threshold, and an orifice configured to limit the flow of hydraulic oil through the backpressure valve.

According to another aspect of the present disclosure, a cooler bypass valve assembly for a hydraulic oil return circuit is disclosed. The cooler bypass valve assembly includes an unloading valve configured to allow hydraulic oil to flow from a control circuit return line to a hydraulic oil tank if a pressure of hydraulic oil in the control circuit return line exceeds a first threshold, a backpressure valve configured to allow hydraulic oil to flow from the control circuit return line to an oil cooler inlet line if the pressure of hydraulic oil in the control circuit return line exceeds a second threshold, the backpressure valve and the unloading valve being arranged in parallel, and an orifice configured to limit the flow of hydraulic oil through the backpressure valve.

According to yet another aspect of the present disclosure, a hydraulic return circuit system is disclosed. The system includes a hydraulic oil tank, an oil cooler, an unloading valve configured to allow hydraulic oil to flow from the control circuit return line to the hydraulic oil tank if a pressure of hydraulic oil in the control circuit return line exceeds a first threshold, a backpressure valve configured to allow hydraulic oil to flow from the return line to the oil cooler through an oil cooler inlet line if a pressure of hydraulic oil in the control circuit return line exceeds a second threshold, an orifice configured to limit the flow of hydraulic oil through the backpressure valve, a shutoff solenoid configured to prevent the backpressure valve from opening if a temperature of the hydraulic oil is below a threshold temperature, and a relief valve on the oil cooler inlet line configured to direct hydraulic oil to the hydraulic oil tank if a pressure in the oil cooler inlet line is greater than a relief valve pressure threshold.

These and other aspects of the present disclosure will be more readily understood after reading the following detailed description in conjunction with the accompanying drawings.

DETAILED DESCRIPTION

Figure 1:
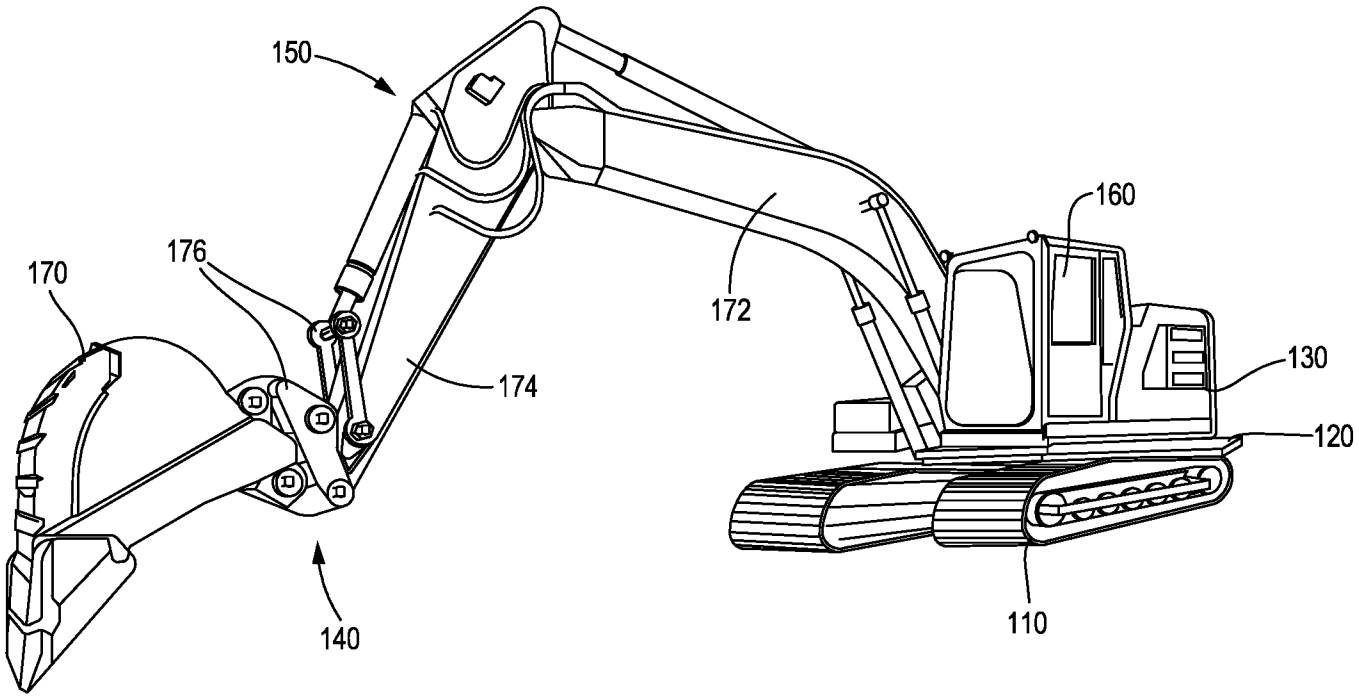
FIG. 1 is a perspective view of a work machine, according to one aspect of the present disclosure.

Referring now to the drawings and with specific reference to FIG. 1, a perspective view of an exemplary work machine is shown and referred to by reference numeral 100. The illustrated work machine is a hydraulic mining shovel, but the present disclosure may also apply to other types of work machines which utilize a hydraulic system, including but not limited to excavators, backhoes, front loaders, and the like. Such work machines are used in a variety of industries such as construction, agriculture, mining, and the like.

The machine 100 includes a traction system 110, a frame 120, an engine 130, an implement system 140, and a hydraulic system 150. The traction system 110 supports the frame 120 and may include wheels, tracks, or other ground engaging devices which allow the machine 100 to move. The frame 120 supports the engine 130 and may be configured to rotate relative to the traction system 110. The frame 110 may also support an operator cab 160.

The implement system 140 may include an implement 170, a plurality of arm segments 172, 174, and a plurality of linkages 176. In the depicted embodiment of a hydraulic shovel, the implement system 140 includes a boom 172, a stick 176, an implement 170, and linkages 176. The implement 170 as illustrated is a shovel bucket, but in some embodiments, other implements may be used, such as, but not limited to, hydraulic hammers, fork lifts, blades, augers, movers, grapples, rippers, saws, and the like.

Figure 2:
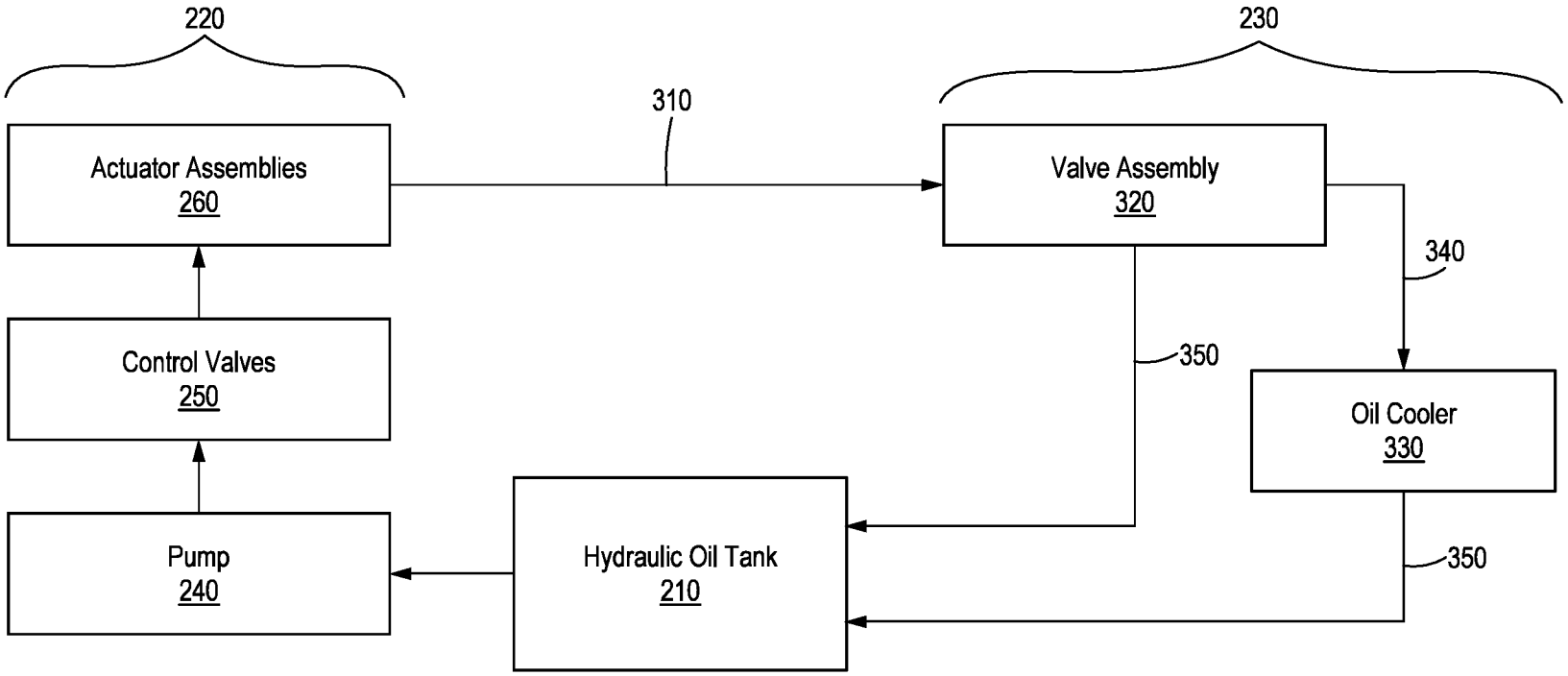
FIG. 2 is a block diagram of a hydraulic system, according to one aspect of the present disclosure.

The hydraulic system 150 drives the movement of the implement system. As shown in block diagram form in FIG. 2, the hydraulic system 150 includes a hydraulic oil tank 210, a control circuit 220, and a return circuit 230. The hydraulic oil tank 210 is configured to contain a hydraulic fluid such as hydraulic oil or other non-compressible fluid.

The control circuit 220 includes a pump 240, a plurality of control valves 250, and a plurality of actuator assemblies 260. The pump 240 conveys the hydraulic oil to the actuator assemblies 260 through pressurized conduits such as hoses. The actuator assemblies 260 are selectively fluidly connected to the pump 240 through the control valves 250 which may be adjusted through a control system and operator interface (not shown). The actuator assemblies 260 may be hydraulic cylinders 270, as depicted in FIG. 1, but may also include hydraulic motors or other types of hydraulic actuators. In particular, the actuator assemblies 260 may also include hydraulic motors which control the rotation of the implement system relative to the ground. The hydraulic cylinders 270 may include chambers separated by a piston assembly. By adjusting the control valves 250, pressurized fluid may be directed into the chambers as needed to extend or retract the hydraulic cylinder 270. The movements of the hydraulic cylinders 270 and other actuators 260 thereby assist in moving the implement system 140 to perform the desired work. The control circuit 220 may also include check valves, pressure relief valves, drain lines, and other known features of hydraulic systems.

Figure 3:
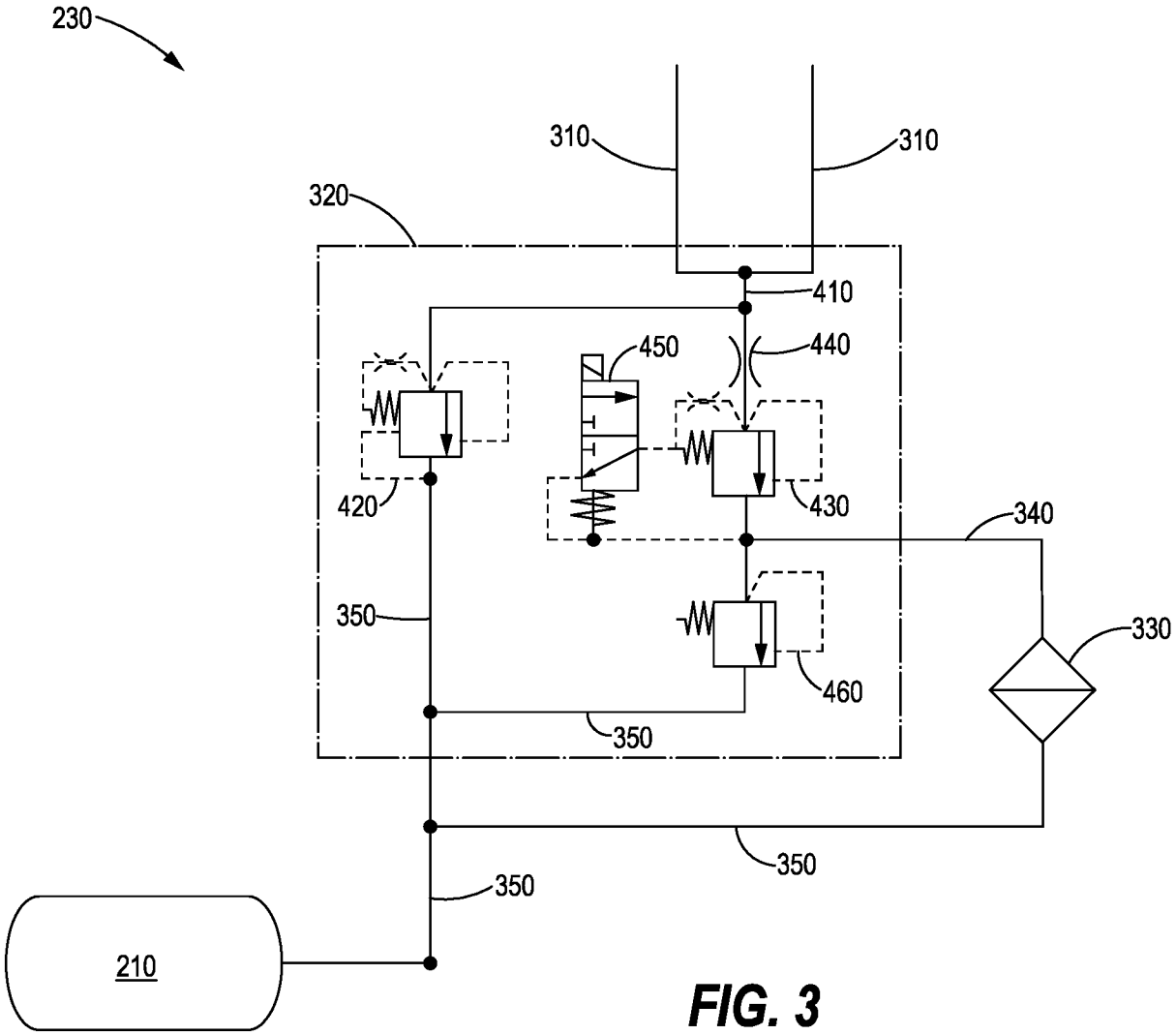
FIG. 3 is a hydraulic schematic of a hydraulic return circuit, according to one aspect of the present disclosure.

The return circuit 230, also shown in more detail in the hydraulic schematic of FIG. 3, returns the hydraulic oil from the actuator assemblies 260 to the hydraulic oil tank 210 and includes at least one control circuit return line 310, a cooler bypass valve assembly 320, an oil cooler 330, an oil cooler inlet line 340, and a plurality of tank inlet lines 350. A portion of the returning oil is directed through the oil cooler 330, while the remainder of the oil bypasses the oil cooler 330 and goes directly to the hydraulic oil tank 210. This division of the oil flow is controlled by the cooler bypass valve assembly 320.

Figure 4:
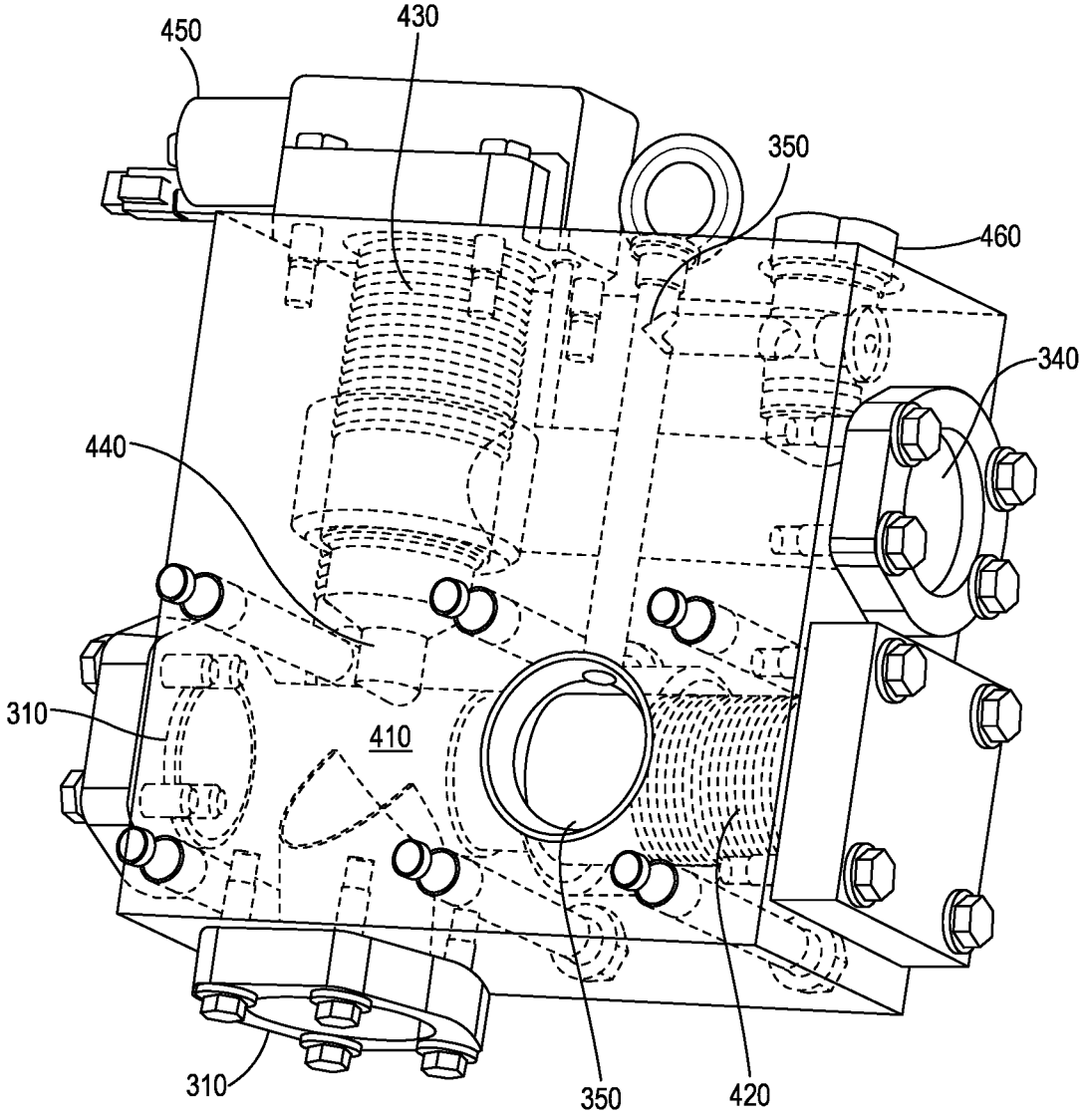
FIG. 4 is a perspective view of a cooler bypass valve assembly for a hydraulic return circuit according to one aspect of the present disclosure.
Figure 5:
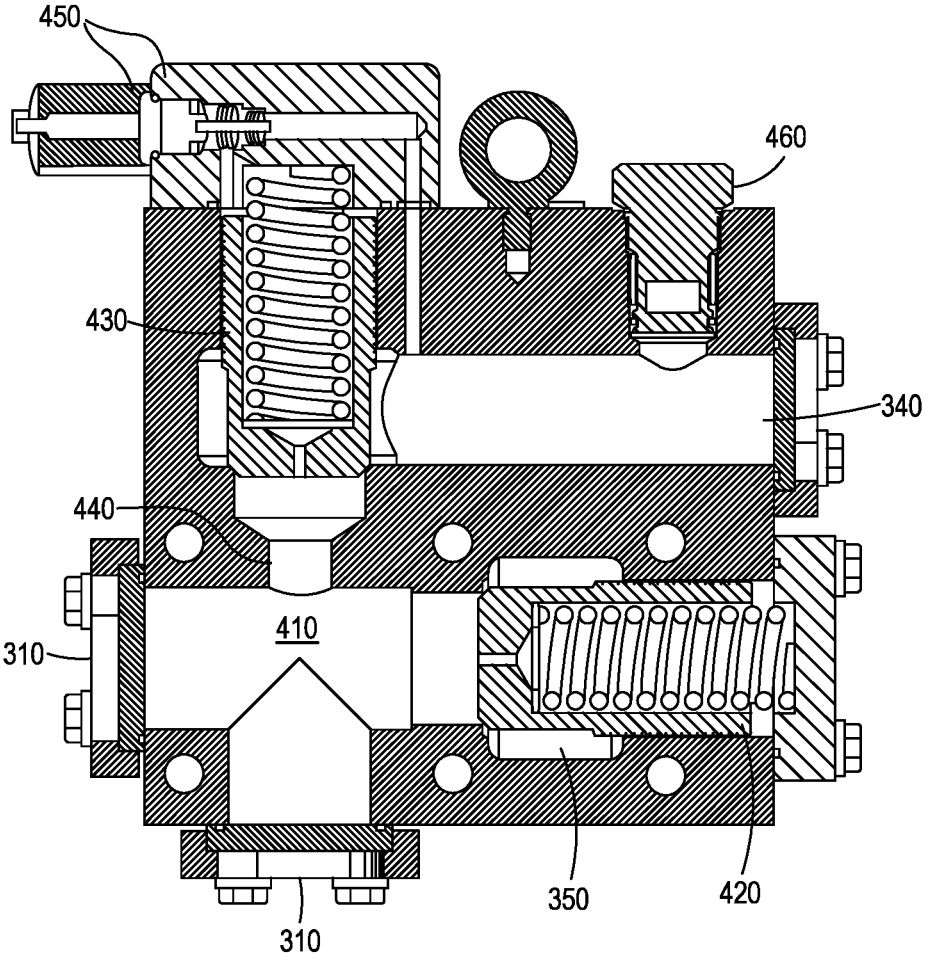
FIG. 5 is a sectional view of the cooler bypass valve assembly of FIG. 4, according to one aspect of the present disclosure.

The cooler bypass valve assembly 320 is shown in FIG. 3, FIG. 4, and FIG. 5, and includes an inlet 410, an unloading valve 420, a backpressure valve 430, an orifice 440. The cooler bypass valve assembly 320 may also include a shutoff solenoid 450 and a relief valve 460.

The inlet 410 is fluidly connected to the actuator assemblies 260 by the control circuit return lines 310. Each actuator assembly 260 may have its own return line 310; however, the lines may converge before or at the inlet 410. The embodiment depicted in FIG. 4 and FIG. 5 shows two control circuit return lines 310 converging at the inlet. Each of these return lines 310 may include the return line of multiple actuators assemblies 260. In some embodiments, a diameter of the return lines 310 at the connection to the inlet may be 40 mm. Of course, other size connections may be utilized.

The unloading valve 420 and the backpressure valve 430 are arranged in parallel in fluid connection with the same inlet 410. Each of the unloading valve 420 and the backpressure valve 430 are configured to be biased closed and open in response to a specific pressure threshold in the inlet 410 and control circuit return lines 310. As shown in FIG. 4 and FIG. 5, they may be spring-biased pressure release valves including a spring-loaded poppet within a bore. In some embodiments, a diameter of the bore of each valve may be 70 mm, although other size valves may be utilized as appropriate for the flow rates of the particular hydraulic system.

The unloading valve 420 is configured to allow hydraulic oil to bypass the oil cooler 330 and flow from the control circuit return lines 310 to the hydraulic oil tank 210 through one of the tank inlet lines 350 if the pressure of hydraulic oil in the control circuit return lines 310 and inlet 410 exceeds a first threshold.

The backpressure valve 430 is configured to allow hydraulic oil to flow from the control circuit return lines 310 to the oil cooler 330 through the oil cooler inlet line 340 if a pressure of hydraulic oil in the control circuit return lines 310 and inlet 410 exceeds a second threshold.

The first threshold is the pressure threshold to open the unloading valve 420. The second threshold is the pressure threshold to open the backpressure valve 430. The first threshold may be greater than the second threshold. In some embodiments the first threshold may be double the pressure of the second threshold. In some specific embodiments, the first threshold may be 10 bar, and the second threshold, may be 5 bar.

The orifice 440 is located at an inlet of the backpressure valve 430. It is configured to limit the flow of oil through the backpressure valve 430. The diameter of the orifice 440 is configured to prevent excessive flow through the oil cooler inlet line. In some embodiments, the diameter of the orifice 440 may be 50-70% of a diameter of the inlet 410 or 30-45% of the diameter of the backpressure valve bore 430. As one example, in the specific embodiment in which the diameter of the inlet 410 is 40 mm and the diameter of the backpressure valve bore 430 is 70 mm, the diameter of the orifice 440 may be 26 mm. Of course, other orifice diameters may be used depending on the required pressures and flow rates.

The diameter of the orifice 440, the first threshold, and the second threshold may be configured such that the flow to the oil cooler inlet line is between 20% and 40% of the total flow through the control circuit return lines 410. In one or more embodiments, the total flow of oil through the control circuit return lines 410 may be 2000-3000 L/min, with 600-800 L/min being directed to the oil cooler 330. However, other flow rates may be used as needed, based on the required total capacity and the amount of cooling required by the hydraulic system 150.

The oil cooler 330 maintains the temperature of the hydraulic oil in the hydraulic system 150 within operating parameters. If the oil temperature is too high, it may result in decreased efficiency, more rapid degradation of the oil, and damage to system components such as seals. An outlet 370 of the oil cooler 330 is in fluid communication with the hydraulic oil tank 120 through one of the tank inlet lines 350. The oil cooler 330 and/or the oil cooler inlet line 340 may also include check valves, pressure relief valves, drain lines, and other features known in the art to improve the function of hydraulic systems.

The shutoff solenoid 450 may be configured to selectively close or prevent the backpressure valve 430 from opening, thereby preventing flow through the backpressure valve 430 to the oil cooler 330. The shutoff solenoid 440 is activated based on a temperature of the oil. In some embodiments, the temperature of the oil may be measured by a temperature sensor (not shown) located on the hydraulic oil tank 210. If the temperature is below a threshold temperature, the shutoff solenoid 440 activates, the backpressure valve 430 is closed and/or prevented from opening. If the backpressure valve 430 is open, the shutoff solenoid 440 may force the valve 430 to close. All the oil is therefore directed through the unloading valve 420 to the hydraulic oil tank 210. The oil cooler 330 may also be shut off based on an oil temperature below the threshold. If the temperature is above the threshold temperature, the shutoff solenoid 440 is not activated and the backpressure valve 430 is able to operate normally as described above. The threshold temperature is a temperature below which the oil no longer needs to be cooled. If the oil is cooled too far, it may increase in viscosity, decreasing efficiency. In some embodiments, the threshold temperature may be 35° C., but other temperatures may be used as required by the characteristics of the particular hydraulic fluid.

The relief valve 450 is a pressure relief valve located downstream of the backpressure valve 430 which is configured to prevent excessive pressure in the oil cooler inlet line. The relief valve 450 opens at a relief valve pressure threshold and is fluidly connected to the hydraulic oil tank 210 through one of the tank inlet lines 350. In some embodiments, the relief valve pressure threshold may be 4 bar, but of course, other threshold pressures may be utilized.

Industrial Applicability

In general, the present disclosure finds application in many different industries, including, but not limited to, earth moving equipment, construction, agriculture, mining, and the like. More specifically, any machine in which a hydraulic system return circuit diverts a portion of returning hydraulic oil through an oil cooler may benefit from the disclosed cooler bypass valve assembly 320.

The cooler bypass valve assembly 320 controls the flow rate and pressure before the cooler bypass valve assembly 320 and before the oil cooler 330 by arranging an unloading valve 420 and a backpressure valve 430 in parallel and using an orifice 440 to restrict the flow towards the oil cooler. Furthermore, although the description refers to a hydraulic system 150 used to control an implement system, it may also find application in other types of hydraulic systems such as in the flight control systems of aircraft. As a result, the present disclosure is applicable to any number of machines with hydraulic systems, including, but not limited to: cars and other vehicles, aircraft, tractors, cranes, bulldozers, backhoes, front loaders, excavators and the like.

Figure 6:
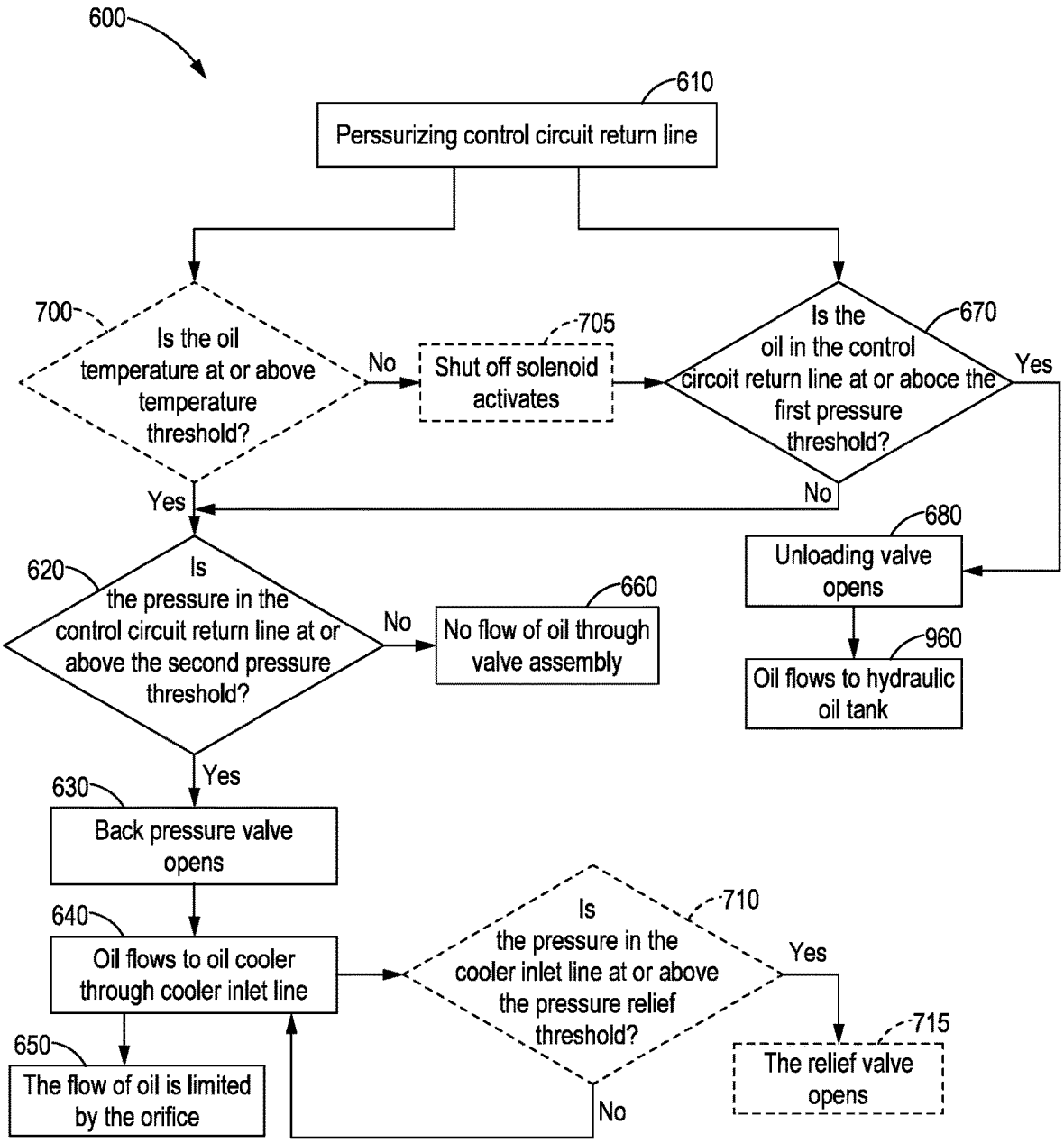
FIG. 6 is a flowchart of a method of operation of the valve assembly of FIG. 4, according to one aspect of the present disclosure.

A method of operation of the cooler bypass valve assembly 320 is shown in FIG. 6, referred to by reference number 600. The method 600 begins with block 610 when the control circuit return lines are pressurized. This occurs when the hydraulic system is in use.

If the pressure in the control circuit return line 310 is at or above a second threshold (block 620), the backpressure valve 430 opens (block 630). This allows hydraulic oil to flow from the control circuit return line 310 to the oil cooler 320 (block 640). The flow through the backpressure valve 430 is limited by the orifice 440 (block 650). If the pressure is below the second threshold, no oil flows through the valve assembly (block 660).

If the pressure in the control circuit return line 310 is at or above a first threshold (block 670), the unloading valve 420 opens (block 680). This allows hydraulic oil to flow from the control circuit return line 310 to the hydraulic tank 210 (block 690).

Optionally, if the temperature is below a threshold temperature (block 700), the shutoff solenoid 440 activates (block 705). All the oil may therefore be directed through the unloading valve 420 (block 670). If the temperature is above the threshold temperature, the shutoff solenoid 440 is not activated and the backpressure valve 430 is able to operate normally per blocks 620-650.

Optionally, if the pressure in the cooler inlet line 340 is at or above the relief valve pressure threshold (block 710), the relief valve 450 opens (block 715). This allows hydraulic oil to flow to the hydraulic tank 210 (block 690).

While the preceding text sets forth a detailed description of numerous different embodiments, it should be understood that the legal scope of protection is defined by the words of the claims set forth at the end of this patent. The detailed description is to be construed as exemplary only and does not describe every possible embodiment since describing every possible embodiment would be impractical, if not impossible. Numerous alternative embodiments could be implemented, using either current technology or technology developed after the filing date of this patent, which would still fall within the scope of the claims defining the scope of protection.

What is claimed is:

1. A work machine, comprising:

a frame;

a traction system supporting the frame;

an implement system supported by the frame; and a hydraulic system configured to drive movement of the implement system, the hydraulic system including a hydraulic oil tank, a control circuit, an oil cooler, and a cooler bypass valve assembly being formed as a unified valve body, the cooler bypass valve assembly being fluidly connected to the control circuit by a control circuit return line and having:

an unloading valve configured to allow hydraulic oil to flow from the control circuit return line to the hydraulic oil tank if a pressure of hydraulic oil in the control circuit return line exceeds a first threshold, the unloading valve being disposed in an unloading valve bore within the unified valve body, a backpressure valve configured to allow hydraulic oil to flow from the return line to the oil cooler through an oil cooler inlet line if a pressure of hydraulic oil in the control circuit return line exceeds a second threshold, wherein the first threshold is greater than the second threshold, the backpressure valve being disposed in a backpressure valve bore within the unified valve body, the unloading valve bore and the backpressure valve bore being perpendicular to each other, and an orifice configured to limit the flow of hydraulic oil through the backpressure valve.

2. The machine of claim 1, wherein the cooler bypass valve assembly includes a shutoff solenoid configured to close the backpressure valve and prevent the backpressure valve from opening if a temperature of oil is below a threshold temperature.

3. The machine of claim 1, wherein the cooler bypass valve assembly includes a relief valve on the oil cooler inlet line configured to direct hydraulic oil to the hydraulic oil tank if a pressure in the oil cooler inlet line is greater than a relief valve pressure threshold.

4. The machine of claim 1, wherein the backpressure valve and the unloading valve are arranged for parallel fluid flow.

5. The machine of claim 1, wherein the cooler bypass valve assembly is configured so that the flow of hydraulic oil through the backpressure valve into the oil cooler inlet line is between 20% and 40% of the total flow through the control circuit return line.

6. The machine of claim 1, wherein a diameter of the orifice is 50-70% of a diameter of the control circuit control line or 30-45% of a diameter of a bore of the backpressure valve.

7. The machine of claim 1, wherein the first threshold is twice the pressure of the second threshold.

8. A cooler bypass valve assembly for a hydraulic oil return circuit, comprising:

an unloading valve configured to allow hydraulic oil to flow from a control circuit return line to a hydraulic oil tank if a pressure of hydraulic oil in the control circuit return line exceeds a first threshold;

a backpressure valve configured to allow hydraulic oil to flow from the control circuit return line to an oil cooler inlet line if the pressure of hydraulic oil in the control circuit return line exceeds a second threshold, wherein the first threshold is greater than the second threshold; and an orifice configured to limit the flow of hydraulic oil through the backpressure valve;

the cooler bypass valve assembly controlling flow by at least one of:

limiting the flow of hydraulic oil through the backpressure valve into the oil cooler inlet line to be between 20% and 40% of the total flow through the control circuit return line;

making a diameter of the orifice 50-70% of a diameter of the control circuit return line or 30-45% of a diameter of a bore of the backpressure valve; and setting the pressure of the first threshold to be twice the pressure of the second threshold.

9. The cooler bypass valve assembly of claim 8, wherein the cooler bypass valve assembly includes a shutoff solenoid configured to prevent the backpressure valve from opening if a temperature of hydraulic oil is below a threshold temperature.

10. The cooler bypass valve assembly of claim 8, wherein the cooler bypass valve assembly includes a relief valve on the oil cooler inlet line configured to direct hydraulic oil to the hydraulic oil tank if a pressure in the oil cooler inlet line is greater than a relief valve pressure threshold.

11. The cooler bypass valve assembly of claim 8, wherein the backpressure valve and the unloading valve are arranged for parallel fluid flow.

12. The cooler bypass valve assembly of claim 8, wherein the flow of hydraulic oil through the backpressure valve into the oil cooler inlet line is between 20% and 40% of the total flow through the control circuit return line.

13. The cooler bypass valve assembly of claim 8, wherein a diameter of the orifice is 50-70% of a diameter of the control circuit return line or 30-45% of a diameter of a bore of the backpressure valve.

14. A hydraulic return circuit system, comprising:

a hydraulic oil tank;

an oil cooler;

a control circuit return line;

an unloading valve configured to allow hydraulic oil to flow from the control circuit return line to the hydraulic oil tank if a pressure of hydraulic oil in the control circuit return line exceeds a first threshold;

a backpressure valve arranged for parallel fluid flow with the unloading valve and configured to allow hydraulic oil to flow from the return line to the oil cooler through an oil cooler inlet line if a pressure of hydraulic oil in the control circuit return line exceeds a second threshold, wherein the first threshold is greater than the second threshold;

an orifice configured to limit the flow of hydraulic oil through the backpressure valve;

a shutoff solenoid configured to prevent the backpressure valve from opening if a temperature of the hydraulic oil is below a threshold temperature; and a relief valve on the oil cooler inlet line configured to direct hydraulic oil to the hydraulic oil tank if a pressure in the oil cooler inlet line is greater than a relief valve pressure threshold, the relief valve being located downstream of the backpressure valve.

15. The system of claim 14, wherein the flow of hydraulic oil through the backpressure valve into the oil cooler inlet line is between 20% and 40% of the total flow through the control circuit return line.

16. The system of claim 14, wherein a diameter of the orifice is 50-70% of a diameter of the inlet or 30-45% of a diameter of a bore of the backpressure valve.

17. The system of claim 14, wherein the first threshold is twice the pressure of the second threshold.

* * * * *